US010888200B1

(12) United States Patent
Brannon

(10) Patent No.: US 10,888,200 B1
(45) Date of Patent: Jan. 12, 2021

(54) SHOWER BASIN

(71) Applicant: Sympateco, Inc., Omaha, NE (US)

(72) Inventor: Curt Brannon, Omaha, NE (US)

(73) Assignee: Sympateco, Inc., Omaha, NE (US)

( * ) Notice: Subject to any disclaimer, the term of this patent is extended or adjusted under 35 U.S.C. 154(b) by 37 days.

(21) Appl. No.: 16/184,186

(22) Filed: Nov. 8, 2018

Related U.S. Application Data

(60) Provisional application No. 62/583,013, filed on Nov. 8, 2017.

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/613, 524; 264/279; 119/753
See application file for complete search history.

(56) References Cited

U.S. PATENT DOCUMENTS 2,085,559 A 6/1937 Weber
2,785,557 A 3/1957 Stilwell, Jr.
3,559,634 A 2/1971 Lillywhite
4,432,104 A 2/1984 Sasaki
5,598,590 A 2/1997 Crawford et al.
6,282,928 B1 9/2001 Fukumoto et al.
6,378,342 B1 4/2002 Fukumoto et al.
6,782,566 B2 * 8/2004 Gedouin ..... A61H 9/00 4/524
6,935,276 B2 * 8/2005 Powers ..... A01K 13/001 119/753
7,832,419 B2 11/2010 Mason et al.
D653,818 S * 2/2012 Schetlin ..... A61H 9/00 D30/158
8,161,582 B2 4/2012 Hatrick-Smith
8,833,387 B2 9/2014 Lucas
8,856,980 B2 * 10/2014 Eriksson ..... A47K 3/40 4/613
8,918,926 B1 12/2014 Herring
9,752,314 B2 * 9/2017 Wiebke ..... E03F 5/0409
9,756,987 B2 * 9/2017 Eriksson ..... A47K 3/40
9,782,045 B2 * 10/2017 Eriksson ..... A47K 3/40
2002/0020197 A1 2/2002 Fukumoto et al.
2007/0067903 A1 3/2007 Hatrick-smith
2007/0186964 A1 8/2007 Mason et al.
(Continued)

FOREIGN PATENT DOCUMENTS

EP 942093 A1 9/1999
EP 1147732 A2 10/2001
(Continued)

*Primary Examiner* — Lori L Baker
(74) *Attorney, Agent, or Firm* — Ryan T. Grace; Advent, LLP

(57) ABSTRACT

A prefabricated shower basin can include a trough with a drain, and a floor with trenches. The trough can be on a first plane, and the floor can be on a second plane above the first plane. The trenches can slope toward the trough, with the trenches on a third plane above the first plane and below the second plane. The prefabricated shower basin can include at least one sidewall that forms a periphery to the floor and trough. In some embodiments, a trench can be disposed on a side of the floor, while in other embodiments, a trench can be disposed in a center of the floor (e.g., between a first floor section and a second floor section).

6 Claims, 8 Drawing Sheets

(56) References Cited

U.S. PATENT DOCUMENTS

| | | | |
|---|---|---|---|
| 2008/0047058 | A1 | 2/2008 | Manzhura et al. |
| 2008/0245115 | A1 | 10/2008 | Cho |
| 2009/0293557 | A1 | 12/2009 | Ahn |
| 2010/0050465 | A1 | 3/2010 | Im et al. |
| 2010/0293708 | A1 | 11/2010 | Hildebrandt |
| 2014/0130902 | A1 | 5/2014 | Lucas |

FOREIGN PATENT DOCUMENTS

| | | | |
|---|---|---|---|
| EP | 1147732 | A3 | 5/2003 |
| EP | 942093 | B1 | 12/2004 |
| EP | 1718190 | A1 | 11/2006 |
| EP | 1818464 | B1 | 3/2011 |
| EP | 2453194 | A1 | 5/2012 |
| EP | 2423394 | B1 | 5/2013 |
| EP | 2591709 | A2 | 5/2013 |
| EP | 2798991 | A1 | 11/2014 |
| WO | 1994023802 | A1 | 10/1994 |
| WO | 2005077235 | A1 | 8/2005 |
| WO | 2006126813 | A2 | 11/2006 |
| WO | 2007026989 | A1 | 3/2007 |
| WO | 2008123695 | A2 | 10/2008 |

* cited by examiner

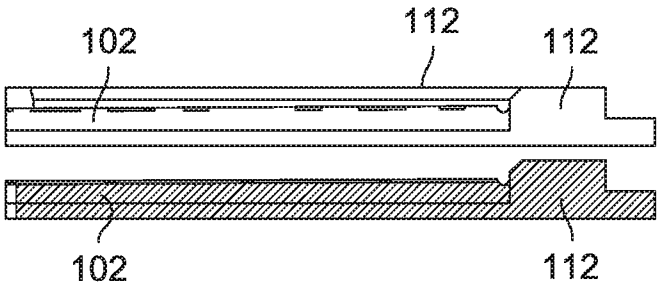
FIG. 5
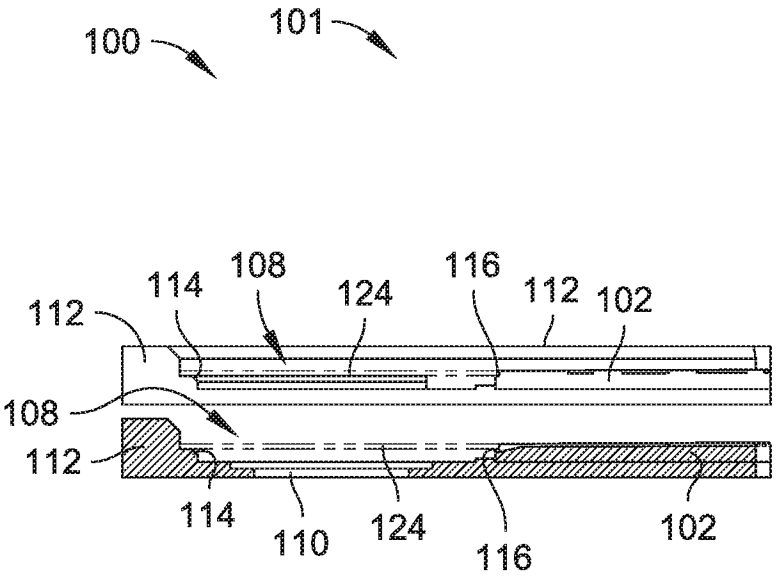

SHOWER BASIN

CROSS-REFERENCE TO RELATED APPLICATIONS

The present application claims the benefit under 35 U.S.C. § 119(e) of U.S. Provisional Application Ser. No. 62/583,013, filed Nov. 8, 2017, and titled "SHOWER BASIN," which is herein incorporated by reference in its entirety.

BACKGROUND

A shower enclosure can include an enclosure configured for allowing an individual to shower while containing water and providing ease for the individual. The shower enclosure can include a water-tight structure with enclosing walls, a floor, and an access door. Some shower enclosures can include a simple rod and shower curtain along with a bath tub, while other shower enclosures can include freestanding models.

DRAWINGS

The Detailed Description is described with reference to the accompanying figures.

FIG. 5 is a partial exploded cross-sectional rear elevation view of the prefabricated shower basin and shower basin system illustrated FIG. 1, taken on the line 5-5 in FIG. 3.

DETAILED DESCRIPTION

Figure 1:
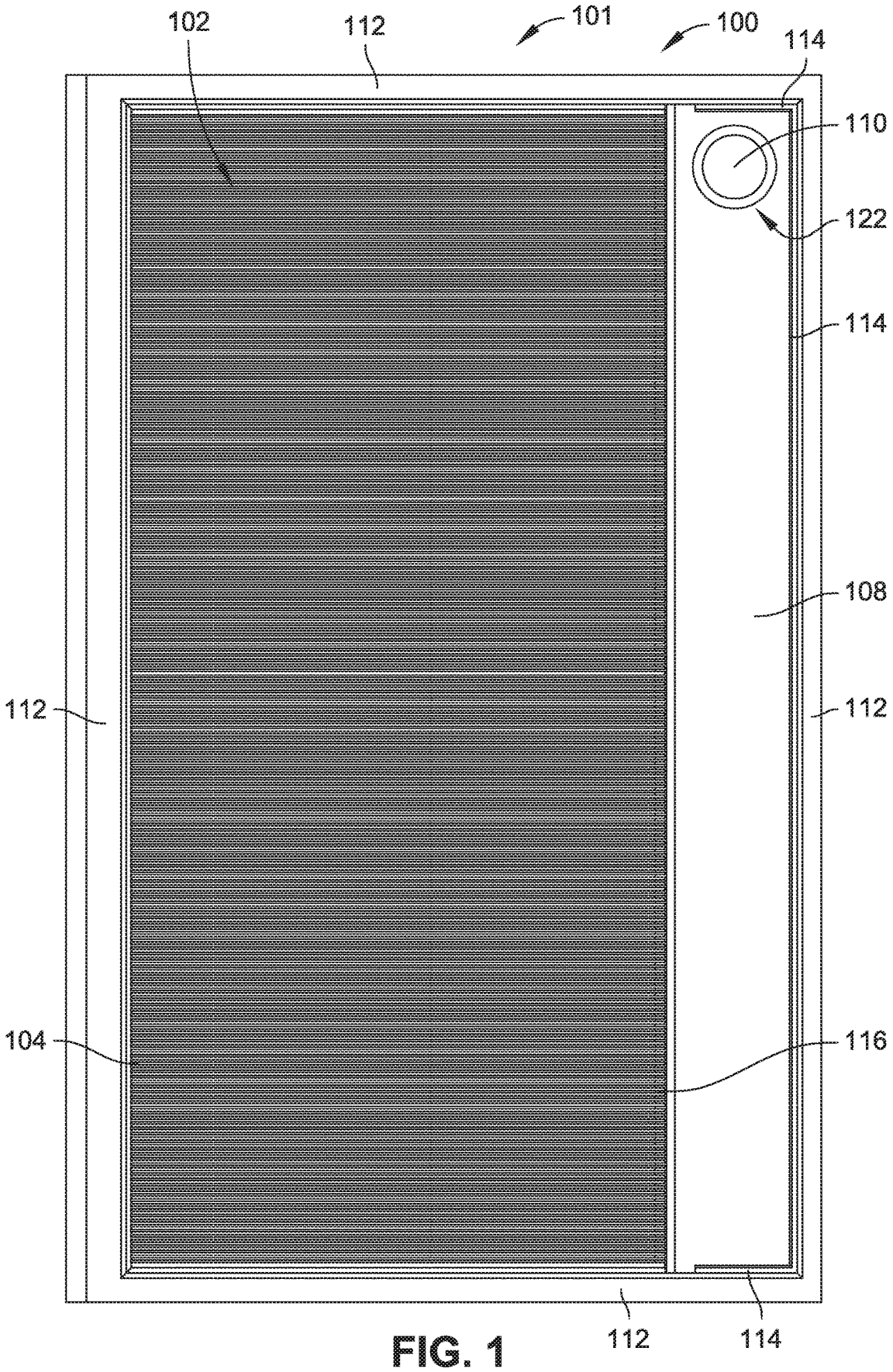
FIG. 1 is a top plan view illustrating a prefabricated shower basin and shower basin system including a floor with trenches that slope toward a trough in accordance with example embodiments of the present disclosure.
Figure 2:
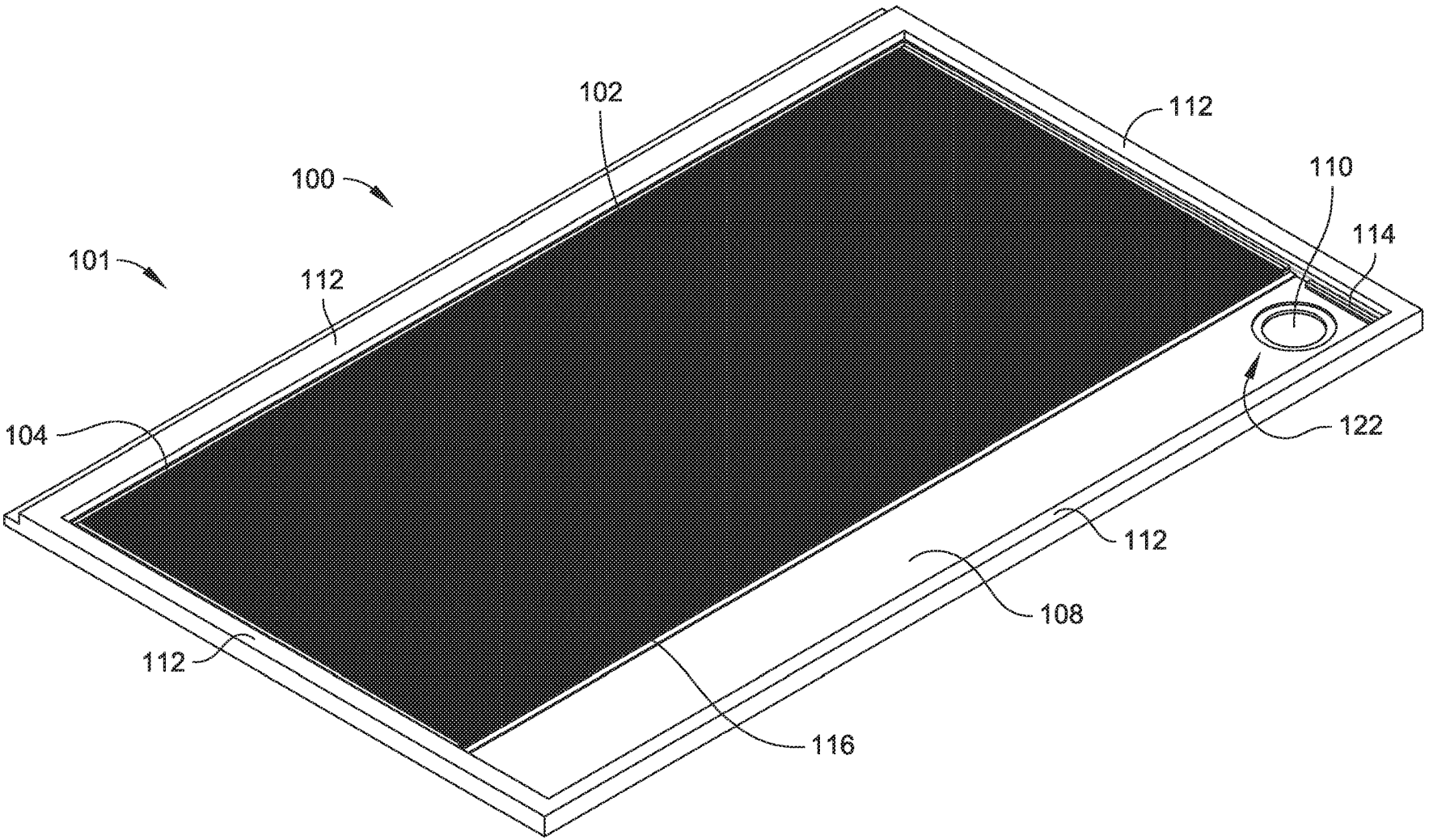
FIG. 2 is an isometric view of the prefabricated shower basin and shower basin system illustrated in FIG. 1.
Figure 3:
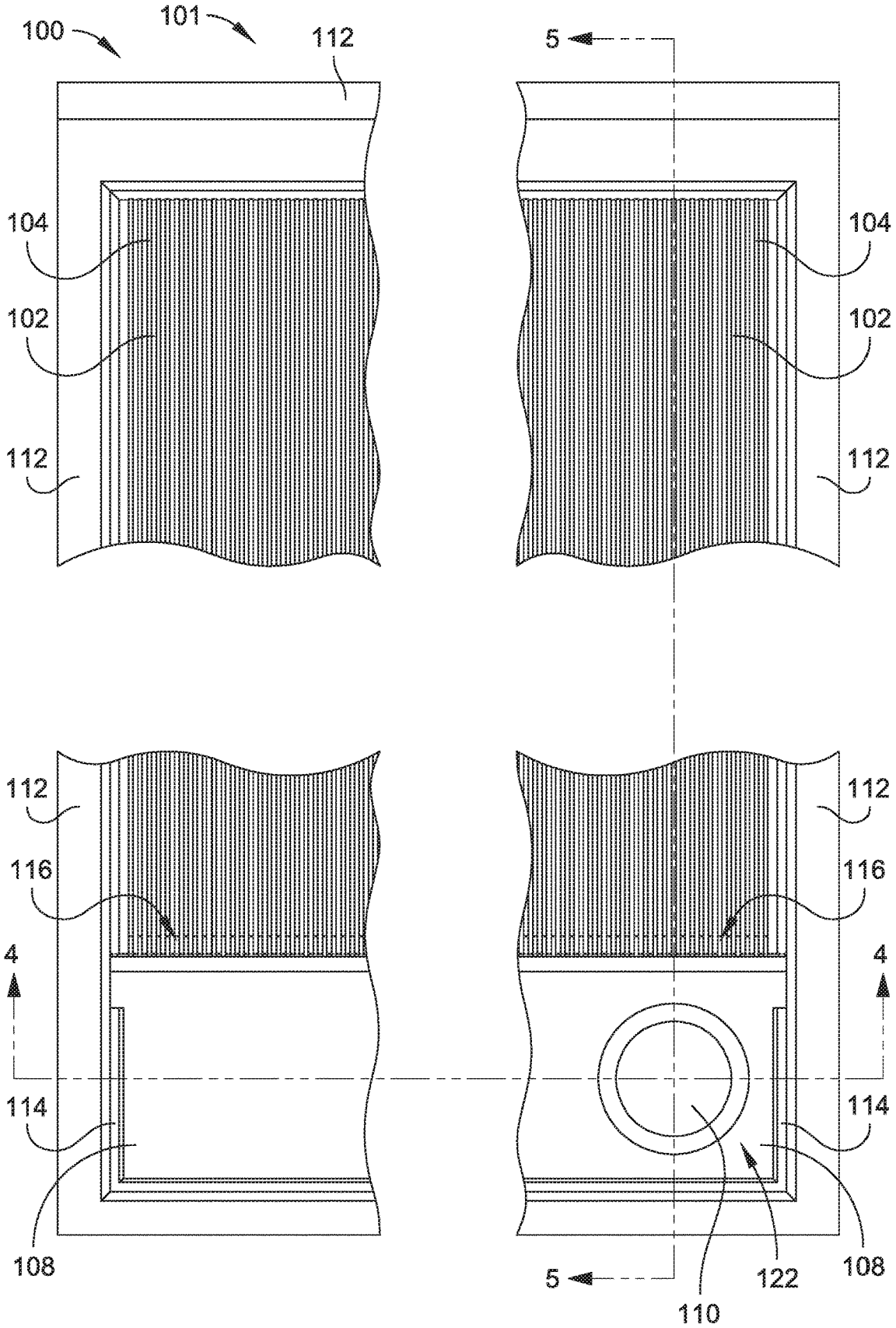
FIG. 3 is a partial exploded top plan view of the prefabricated shower basin and shower basin system illustrated in FIG. 1.
Figure 4:
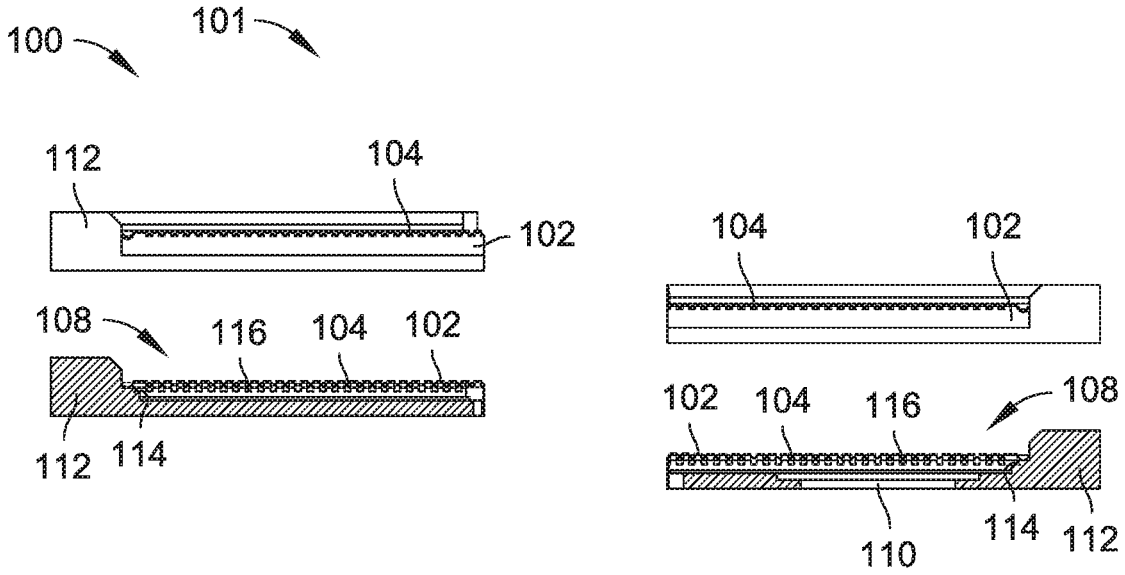
FIG. 4 is a partial exploded cross-sectional right side elevation view of the prefabricated shower basin and shower basin system illustrated in FIG. 1, taken on the line 4-4 in FIG. 3.
Figure 6:
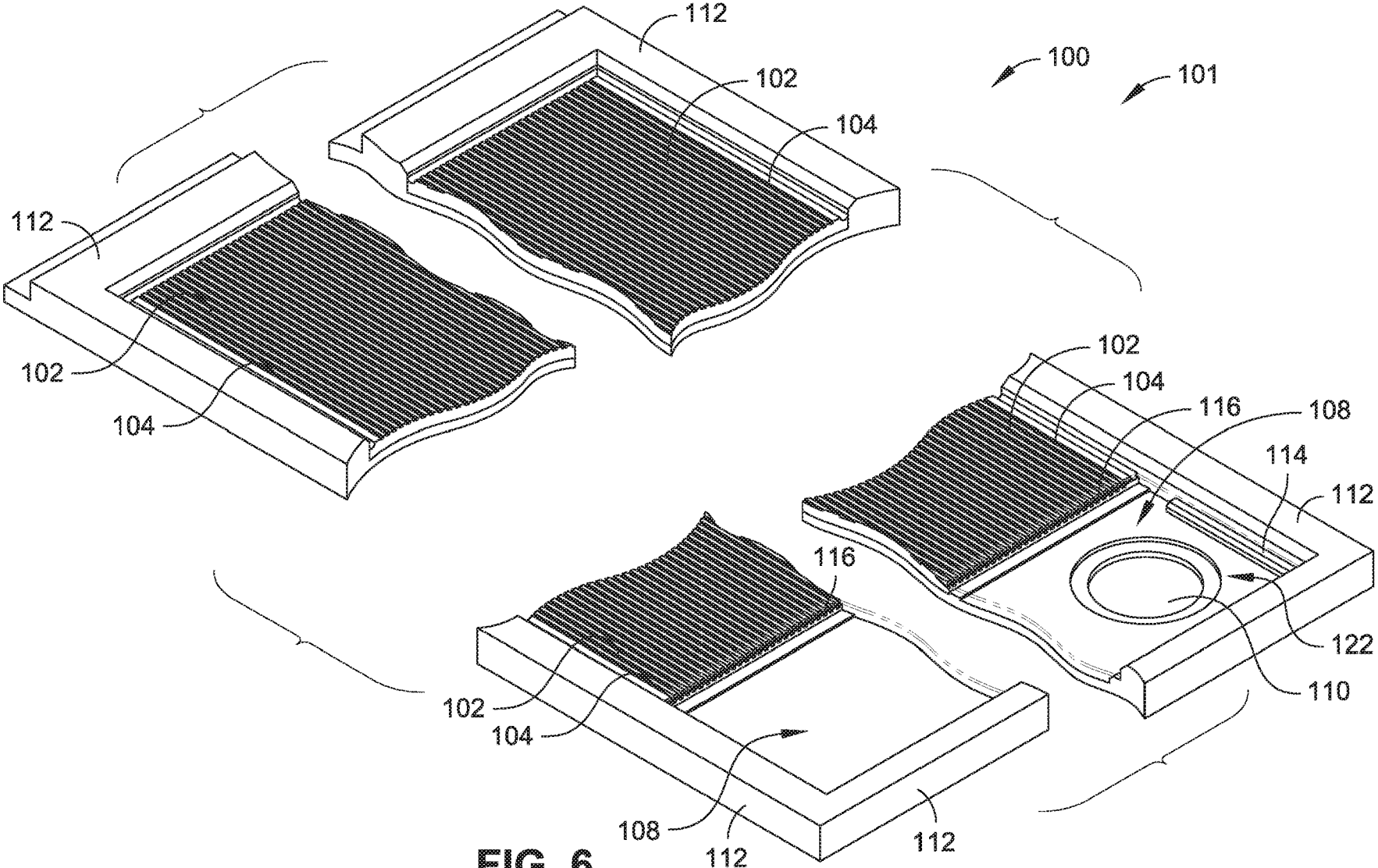
FIG. 6 is a partial exploded isometric view illustrating of the prefabricated shower basin and shower basin system illustrated in FIG. 1.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

A bathtub floor or shower enclosure can be designed to easily drain water, such as with a sloped floor. In some instances, however, the floor of a bathtub or shower enclosure may not be sufficient for quickly draining water, even when sloped. For example, if a wheelchair or a supportive crutch is used in a shower, water on the floor may not drain well enough to provide a grip sufficient for a wheel on the wheelchair or a bottom pad on the supportive crutch to grip the wet floor.

In addition, some shower enclosures are required to comply with the Americans with Disabilities Act ("ADA") and/or to be accessible for those with disabilities. Providing a shower enclosure and/or a bathtub that drains water faster and more efficiently provides more accessibility for a disabled person as well as providing a generally more useful shower or bath enclosure.

Accordingly, a prefabricated shower basin and a shower basin system are described herein that include a floor having trenches that slope toward and empty into a trough with a drain. The prefabricated shower basin and the shower basin system described herein are configured to drain water from the floor more quickly and more efficiently so that the draining water is less likely to create a slipping hazard for an individual in the shower. Further, the trough provides a collection repository for the draining water for when the drain may not be able to remove the water as quickly as the water moves toward the drain.

Referring generally to FIGS. 1 through 8, a prefabricated shower basin 100 and shower basin system 101 are described. The prefabricated shower basin 100 and shower basin system 101 include a floor 102 having trenches 104, where a top (e.g., uppermost) surface of the floor 102 can be substantially flat or level, or at least perceived as flat or level to a user. The floor 102 provides a user with a support surface to stand on, while the trenches 104 within the floor 102 direct water from the floor 102 to a trough 108 having a drain 110. In implementations, the floor 102 can be on one plane (e.g., a flat or level plane), while the trenches 104 can be on another plane (e.g., a plane below the flat or level plane). For the purposes of the present disclosure, the language "on a plane" shall be understood to mean that a top or upwardly facing surface of the structure described lies at least generally along the plane described. For example, in the case of the floor 102 being on one plane, the top (e.g., uppermost) surface of the floor 102 can lie substantially along a flat or level plane. In the case of the trenches, the upwardly facing (e.g., lowermost) surface of a trench 104 can lie substantially along another plane (e.g., beneath the plane of the floor 102). Additionally, the trenches 104 can be parallel to one another and can be defined by a variety of widths, depths, and/or distances from each other. The trenches 104 can be sloped toward the trough 108 so that water falling from a shower head to the floor 102 will migrate into the trenches 104 and flow to the trough 108. For example, the plane along which the trenches 104 lie can slope with respect to the flat or level plane along which the floor 102 lies.

In embodiments, the prefabricated shower basin 100 and shower basin system 101 can include a trough 108 that is coupled to the floor 102 and is configured to direct water from the trenches 104 to a drain 110. The trough 108 can be on another plane different from the plane of the floor 102 and/or the plane of the trenches 104. For example, the trough 108 can be on a plane below the plane of the floor 102 and possibly below the plane of the trenches 104. The trough 108 may also be on a plane at least generally parallel (e.g., coplanar) with the plane of the trenches 104. In some embodiments, the plane along which the trough 108 lies may be flat or level, while in other embodiments, the plane of the trough 108 may slope towards the drain 110 (e.g., from one or more directions). Water that is flowing in the trenches 104 can empty into the trough 108 and can continue to flow through the trough 108 to the drain 110. The water flowing in the trenches 104 can flow in a first lateral direction (e.g., toward the trough 108) and the water flowing in the trough 108 can flow in a second lateral direction (e.g., toward the drain 110 and perpendicular to the first lateral direction). In some instances, the drain 110 can be disposed in the trough 108 on one side 122 of the trough 108. In other instances, the drain 110 can be disposed in the center 120 of the trough 108. In embodiments, the drain 110 can be defined by a hole in the trough 108 through which water can flow out of the prefabricated shower basin 100 and shower basin system 101. The floor 102 and/or the trough 108 can be formed of a variety of materials and can be cast and/or compression molded in one piece or in multiple pieces that can be connected together. For example, the floor 102 and/or the trough 108 can be formed of one or more fiberglass and/or acrylic materials. Additionally, the floor 102 and/or the trough 108 can include a cast or compression molded composite material. One specific example of a composite material can include marble dust, polyester, and/or acrylic resin mixed with powdered bauxite filler and pigments.

Figure 7:
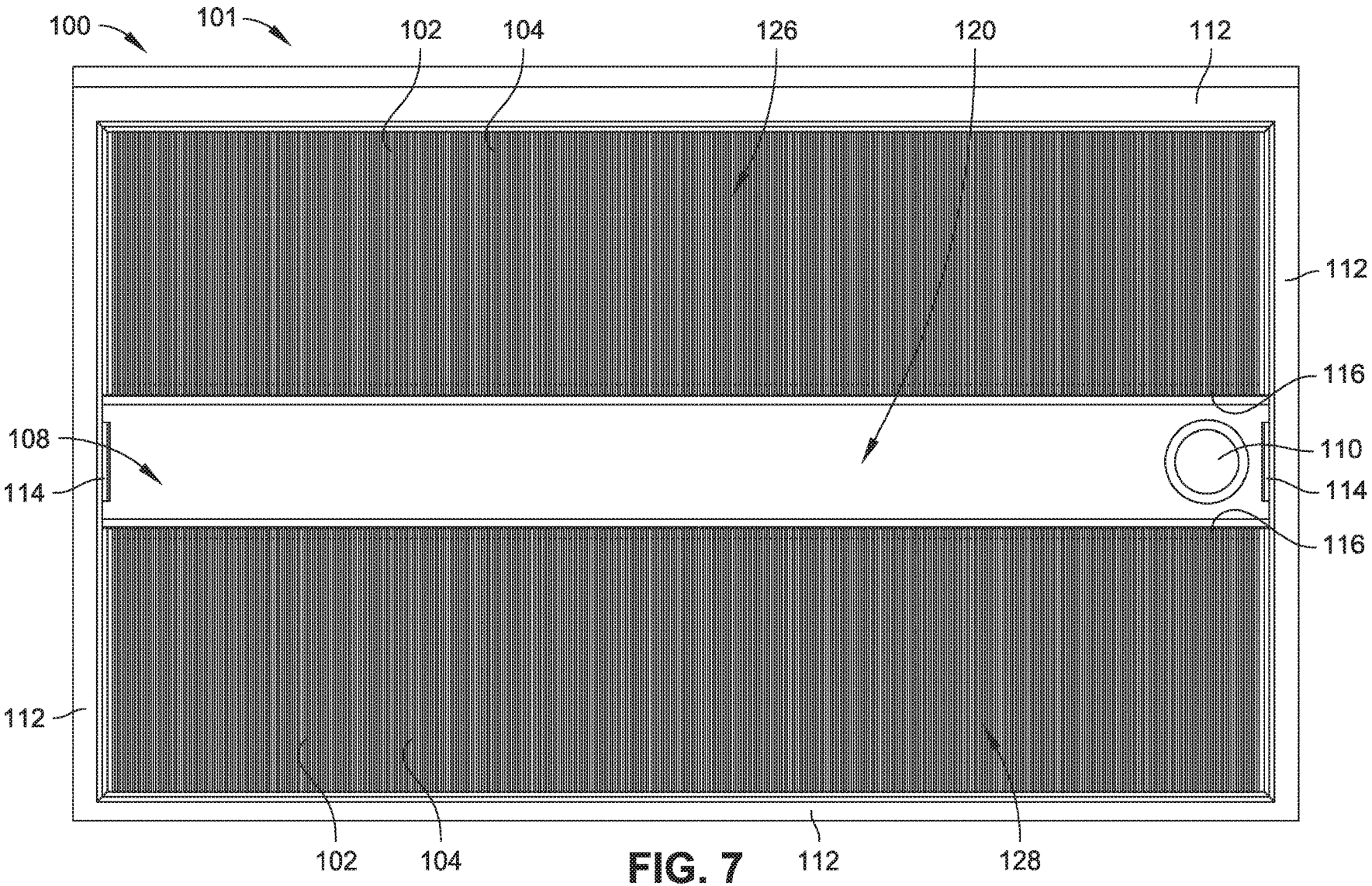
FIG. 7 is a top plan view illustrating another prefabricated shower basin and shower basin system including a floor with trenches that slope toward a trough in accordance with example embodiments of the present disclosure.
Figure 8:
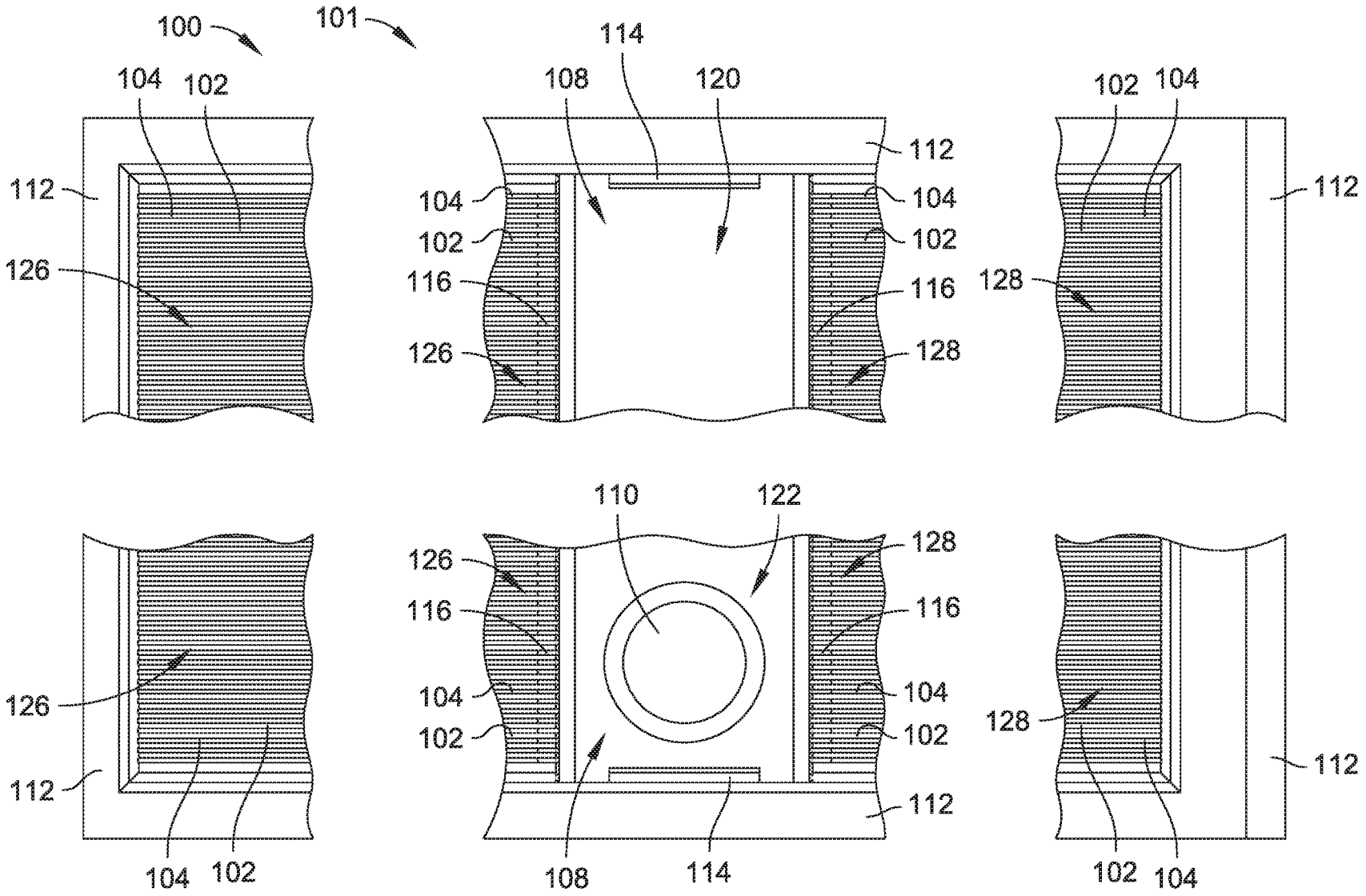
FIG. 8 is a partial exploded top plan view of the prefabricated shower basin and shower basin system illustrated in FIG. 7.

With reference to FIGS. 1 through 6, in some embodiments, the floor 102 can include a single section with the trough 108 located on one side 122 of the floor 102. With reference to FIGS. 7 and 8, in some embodiments, the floor 102 can include a first section 126 and a second section 128 that are separated by the trough 108. In this configuration, the floor 102 can be on a first plane, the trough 108 can be on a second plane, the trenches 104 within the first section 126 can be on a third plane, and the trenches 104 within the second section 128 can be on a fourth plane, e.g., where the third and fourth planes can each slope toward the trough 108 relative to the plane of the floor 102.

At least one sidewall 112 can be coupled to the floor 102 and/or the trough 108 to form a periphery of the prefabricated shower basin 100 and/or shower basin system 101. The sidewall(s) 112 can extend perpendicularly from the floor 102 and/or the trough 108 to prevent water from escaping the prefabricated shower basin 100 and/or shower basin system 101. In the embodiments illustrated in FIGS. 1 through 8, the prefabricated shower basin 100 and shower basin system 101 are depicted as having four sides with a sidewall 112 disposed on each of the four sides and coupled to the floor 102 and/or the trough 108. It is contemplated that other configurations may be implemented. For example, the prefabricated shower basin 100 and/or shower basin system 101 can include only three sidewalls 112. The sidewall(s) 112 can be formed of the same or similar material as the floor 102 and/or the trough 108 (e.g., fiberglass, acrylic, composite materials, etc.). In some embodiments, one or more sidewalls may extend upwardly to form shower or bath walls (e.g., in the manner of a one-piece shower or bath kit).

In some embodiments, the prefabricated shower basin 100 and/or shower basin system 101 can include a cover 124 disposed over the trough 108. In these implementations, the floor 102 can include a recessed floor edge 116 disposed on an edge of the floor proximate to the trough 108 and at least one ledge 114 coupled to at least one sidewall 112 and/or the trough 108. The cover 124 can be positioned on the at least one ledge 114 and the recessed floor edge 116 so that a surface of the cover 124 may be flat or even (e.g., flush or at least substantially flush) with respect to the floor 102. For example, as described with reference to FIGS. 7 and 8, the first section 126 can include a recessed floor edge 116, and the second section 126 can also include a recessed floor edge 116. When the cover 124 is positioned on the recessed floor edges 116, water from the trenches 104 can flow out of the trenches 104 and into the trough 108. In some implementations, the cover 124 can be formed from various materials, including, but not necessarily limited to: a glass or a polymer. In some embodiments, a cover 124 can be transparent, opaque, and/or translucent.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A shower basin system, comprising:

a trough including a drain, the trough on a first plane;

a floor including a plurality of trenches, the trenches sloping toward and emptying into the trough, the floor on a second plane above the first plane, the trough disposed between a first section and a second section of the floor; and at least one sidewall coupled to the floor and the trough, the at least one sidewall forming a periphery of the shower basin system.

2. The shower basin system of claim 1, wherein a first plurality of trenches within the first section of the floor are on a third plane above the first plane and below the second plane, and a second plurality of trenches within the second section of the floor are on a fourth plane above the first plane and below the second plane.

3. The shower basin system of claim 1, wherein at least one of the first section of the floor or the second section of the floor includes at least one recessed edge proximate to the trough, and the at least one sidewall includes at least one ledge.

4. The shower basin system of claim 3, further comprising a cover disposed on the at least one ledge and the at least one recessed edge of the at least one of the first section of the floor or the second section of the floor, the cover positioned over the trough.

5. The shower basin system of claim 4, wherein the cover is a transparent cover.

6. The shower basin system of claim 5, wherein the transparent cover is formed of at least one of a glass or a polymer.

* * * * *